US012637729B2

(12) United States Patent
Kang et al.

(10) Patent No.: US 12,637,729 B2
(45) **Date of Patent: *May 26, 2026**

(54) HIGH-STRENGTH HIGH-TOUGHNESS THICK STEEL PLATE AND MANUFACTURING METHOD THEREFOR

(71) Applicant: POSCO CO., LTD, Pohang-si (KR)

(72) Inventors: Mo-Chang Kang, Seoul (KR); Dea-Young Jang, Seoul (KR)

(73) Assignee: POSCO CO., LTD, Gyeongsangbuk-Do (KR)

( * ) Notice: Subject to any disclaimer, the term of this patent is extended or adjusted under 35 U.S.C. 154(b) by 755 days.

This patent is subject to a terminal disclaimer.

(21) Appl. No.: 16/471,299

(22) PCT Filed: Dec. 21, 2017

(86) PCT No.: PCT/KR2017/015272

§ 371 (c)(1),
(2) Date: Jun. 19, 2019

(87) PCT Pub. No.: WO2018/117700

PCT Pub. Date: Jun. 28, 2018

(65) Prior Publication Data

US 2020/0017931 A1 Jan. 16, 2020

(30) Foreign Application Priority Data

Dec. 22, 2016 (KR) ..... 10-2016-0176514

(51) Int. Cl.

| | |
|---|---|
| ***C21D 9/46*** | (2006.01) |
| ***C21D 6/00*** | (2006.01) |
| ***C21D 8/02*** | (2006.01) |
| ***C21D 8/0221*** | (2026.01) |
| ***C22C 38/00*** | (2006.01) |
| ***C22C 38/02*** | (2006.01) |
| ***C22C 38/46*** | (2006.01) |
| ***C22C 38/48*** | (2006.01) |
| ***C22C 38/50*** | (2006.01) |
| ***C22C 38/58*** | (2006.01) |

(52) U.S. Cl.

CPC ..... *C21D 9/46* (2013.01); *C21D 6/004* (2013.01); *C21D 6/005* (2013.01); *C21D 6/008* (2013.01); *C21D 8/02* (2013.01); *C21D 8/0226* (2013.01); *C22C 38/002* (2013.01); *C22C 38/02* (2013.01); *C22C 38/46* (2013.01); *C22C 38/48* (2013.01); *C22C 38/50* (2013.01); *C22C 38/58* (2013.01); *C21D 2211/001* (2013.01); *C21D 2211/005* (2013.01)

(58) Field of Classification Search

CPC ..... C21D 2211/001; C21D 2211/005; C21D 9/46; C21D 6/004; C21D 6/005; C21D 6/008; C22C 38/002; C22C 38/02; C22C 38/46; C22C 38/48; C22C 38/50; C22C 38/58

See application file for complete search history.

(56) References Cited

U.S. PATENT DOCUMENTS

| | | | | |
|---|---|---|---|---|
| 2001/0050119 | A1 | 12/2001 | Inoue et al. | |
| 2003/0131914 | A1 | 7/2003 | Jeong et al. | |
| 2009/0277544 | A1 | 11/2009 | Toyoda et al. | |
| 2012/0031532 | A1* | 2/2012 | Ishikawa | C21D 8/10 148/333 |
| 2016/0348202 | A1 | 12/2016 | Nakano | |
| 2016/0369759 | A1 | 12/2016 | Masuda et al. | |

FOREIGN PATENT DOCUMENTS

| | | | | |
|---|---|---|---|---|
| CN | 102851584 | A | | 1/2013 |
| CN | 104264030 | A | | 1/2015 |
| CN | 104846293 | A | * | 8/2015 |
| JP | H05-125442 | A | | 5/1993 |
| JP | H05-195058 | A | | 8/1993 |
| JP | H06-264181 | A | | 9/1994 |
| JP | 2002069572 | A | * | 3/2002 |
| JP | 2004-514060 | A | | 5/2004 |
| JP | 2004-232091 | A | | 8/2004 |
| JP | 2005-344167 | A | | 12/2005 |
| JP | 2007-119857 | A | | 5/2007 |
| KR | 10-2015-0065488 | A | | 6/2015 |
| KR | 10-2016-0075926 | A | | 6/2016 |
| KR | 10-2016-0104028 | A | | 9/2016 |
| KR | 10-2016-0125489 | A | | 10/2016 |
| KR | 10-2016-0138771 | A | | 12/2016 |

(Continued)

OTHER PUBLICATIONS

Han-hui Ding, Guo-ai He, Xin Wang, Feng Liu, Lan Fuang, Liang Jiang, Effect of Cooling rate on microstructure and tensile properties of powder metallurgy Ni-based superalloy, 2017 (Year: 2017).*

Chinese Office Action dated Jul. 17, 2020 issued in Chinese Patent Application No. 201780079934.0 (with English translation).

Japanese Office Action dated Jul. 21, 2020 issued in Japanese Patent Application No. 2019-531453.

Communication Pursuant to Article 94(3) EPC issued in corresponding European Patent Application No. 17 882 911.5 dated Oct. 12, 2020.

ASTM International, Designation: E29-13, "Standard Practice for Using Significant Digits in Test Data to Determine Conformance with Specifications", 2014.

Extended European Search Report dated Oct. 22, 2019 issued in European Patent Application No. 17882911.5.

*Primary Examiner* — Jonathan Johnson

(74) *Attorney, Agent, or Firm* — Morgan Lewis & Bockius LLP

(57) ABSTRACT

The objective of one aspect of the present invention is to provide: a thick steel plate having high strength and high toughness without carrying out accelerated cooling using water cooling, in the manufacturing, by means of a thermo-mechanical control process (TMCP), of a thick steel having a thickness of 15 mmt and over; and a method for manufacturing the same.

7 Claims, No Drawings

(56) References Cited

FOREIGN PATENT DOCUMENTS

| | | | | |
|---|---|---|---|---|
| WO | WO-2013022043 A1 * | 2/2013 | ..... | C21D 8/0426 |
| WO | WO-2013046695 A1 * | 4/2013 | ..... | C23C 2/28 |

* cited by examiner

HIGH-STRENGTH HIGH-TOUGHNESS THICK STEEL PLATE AND MANUFACTURING METHOD THEREFOR

CROSS-REFERENCE OF RELATED APPLICATIONS

This application is the U.S. National Phase under 35 U.S.C. § 371 of International Patent Application No. PCT/KR2017/015272, filed on Dec. 21, 2017, which in turn claims the benefit of Korean Patent Application No. 10-2016-0176514, filed Dec. 22, 2016, the entire disclosures of which applications are incorporated by reference herein.

TECHNICAL FIELD

The present disclosure relates to a thick steel plate having high-strength and high-toughness and a manufacturing method therefor.

BACKGROUND ART

Toughness of steel is a property, contrary to strength, and it is difficult to secure excellent levels of both the strength and the toughness.

In the related art, it has been attempted to simultaneously secure strength and toughness in high alloy steel materials, using heat treatments. However, there may be a problem of a cost increase due to the use of relatively expensive alloying elements, as well as defects in welding and cutting due to high alloying amounts.

In this regard, a heat control rolling technique for adjusting alloy elements and optimizing a microstructure by control of rolling and cooling conditions to secure toughness and strength has been developed and utilized.

Meanwhile, when a thickness of a steel material is less than 15 mmt, the thickness is thin, and even when air cooling is carried out during cooling after rolling, sufficient cooling rate may be obtained up to an inside the steel material. However, when the thickness is 15 mmt and over, internal latent heat is high, such that the air cooling process may have a limitation in drawing sufficient cooling rate.

For this reason, an accelerated cooling technique inducing microstructure refinement, while adjusting a cooling rate through water cooling during cooling after rolling, is utilized for general steel materials of 15 mmt and over.

However, for carrying out the above-mentioned accelerated cooling, a proper facility is required, and there is a disadvantage in which strict control is required because uneven cooling due to partial unstable operations may cause effects of flatness such as wave, and others, during processing due to variations in residual internal stress.

Therefore, in manufacturing a thick steel having a thickness of 15 mmt and over, it is required to develop a method for stably securing product quality while significantly reducing facility investment.

(Patent Document 1) Korean Patent Laid-Open Publication No. 10-2016-0138771

DISCLOSURE

Technical Problem

An aspect of the present disclosure is to provide: a thick steel plate having high-strength and high-toughness without carrying out accelerated cooling using water cooling, in the manufacturing, by means of a Thermo-Mechanical Control Process (TMCP), of a thick steel having a thickness of 15 mmt and over; and a method for manufacturing the same.

Technical Solution

According to an aspect of the present disclosure, a high-strength and high-toughness thick steel plate may include: by weight (%), 0.02 to 0.10% of carbon (C), 0.6 to 1.7% of manganese (Mn), 0.5% or less of silicon (Si) (excluding 0%), 0.02% or less of phosphorus (P), 0.015% or less of sulfur (S), 0.005 to 0.05% of niobium (Nb), 0.005 to 0.08% of vanadium (V), a balance of iron (Fe) and inevitable impurities and having a microstructure composed of ferrite and pearlite mixed structures, wherein a grain size of austenite is ASTM grain size number of 10 or more, and a grain size of ferrite is ASTM grain size number of 9 or more.

According to an aspect of the present disclosure, a manufacturing method of the high-strength and high-toughness thick steel plate may include steps of: reheating a steel slab satisfying the alloy composition described above at a temperature of 1100° C. or higher; performing finish hot rolling the reheated steel slab at a temperature within a range of 780° C. to 850° C. to prepare a hot-rolled steel plate; and performing air cooling to room temperature after performing the finish hot rolling.

Advantageous Effects

According to the present disclosure, it is possible to provide a thick steel plate capable of stably ensuring impact toughness from 0° C. to −70° C.

As described above, there is an economically advantageous effect by providing a thick steel plate with high efficiency even after accelerated cooling is not performed during cooling after rolling.

BEST MODE FOR INVENTION

The present inventors have conducted intensive research to provide a steel plate having a physical property equal to or more than that of a steel plate manufactured by a conventional method without carrying out a conventional water cooling process, in the manufacturing a thick steel having a thickness of 15 mmt and over, by means of a Thermo-Mechanical Control Process (TMCP).

As a result, since alloy composition and manufacturing conditions are optimized, it has been confirmed that it is possible to manufacture a thick steel plate having desired physical properties even when air cooling is performed during cooling after rolling, thereby completing the present disclosure.

In particular, in order to overcome a cooling effect by not performing accelerated cooling, it is technically significant to excellently secure strength and toughness by utilizing V in a steel alloy composition while finely controlling a microstructure.

Hereinafter, the present disclosure will be described in detail.

According to an aspect of the present disclosure, a thick steel plate having high-strength and high-toughness may preferably comprise, by weight %: 0.02 to 0.10% of carbon (C), 0.6 to 1.7% of manganese (Mn), 0.5% or less of silicon (Si), 0.02% or less of phosphorus (P), 0.015% or less of sulfur (S), 0.005 to 0.05% of niobium (Nb), and 0.005 to 0.08% of vanadium (V).

Hereinafter, the reason why the alloy composition of the steel plate of the present disclosure is controlled as described above will be described in detail. In this case, the content of each element means weight % unless otherwise specified.

C: 0.02 to 0.10%

Carbon (C) is an essential element for strengthening of steel. However, when a content of C is excessive, a rolling load during rolling may increase due to increase of high-temperature strength, and instability of toughness at a cryogenic temperature of −20° C. or less may be induced.

Meanwhile, when the content of C is less than 0.02%, it is difficult to secure the strength required in the present disclosure, and in order to control the content of C to less than 0.02%, a decarburization process may be additionally required, which may lead to an increase in costs. On the other hand, when the content thereof exceeds 0.10%, a rolling load may be increased and the rolling in a temperature range controlled by the present disclosure may not be properly performed, and it may be difficult to control other elements favorable to the strengthening of steel, and the toughness may not be sufficiently obtained.

Therefore, in the present disclosure, it is preferable to control the content of C to 0.02 to 0.10%.

Mn: 0.6 to 1.7%

Manganese (Mn) is an essential element for securing impact toughness of steel and controlling impurity elements such as S, but when manganese is added in excess with C, weldability may be down.

In the present disclosure, as described above, the toughness of steel may be effectively secured by controlling the content of C, and in order to obtain high strength, the strength may be improved with Mn without adding the C, such that impact toughness may be maintained.

It is preferable that Mn is contained in an amount of 0.6% or more for the above-mentioned effect. However, when the content thereof exceeds 1.7%, the weldability may be deteriorated due to an excess of a carbon equivalent, and there is a problem in which toughness is lowered in only a portion of the thick steel plate and cracks are generated due to segregation during casting may occur.

Therefore, in the present disclosure, it is preferable to control the content of Mn to 0.6 to 1.7%.

Si: 0.5% or Less (Excluding 0%)

Silicon (Si) is a major element for killed steel, and is an element favorable for securing strength of steel by solid solution strengthening.

However, when a content of Si exceeds 0.5%, there is a problem that a load during rolling is increased and toughness of a welded portion during welding is deteriorated with a base material (a thick steel plate itself).

Therefore, in the present disclosure, the content of Si is controlled to be 0.5% or less, and 0% is excluded.

P: 0.02% or Less

Phosphorus (P) is an element which is inevitably contained during manufacturing of steel, and is an element which is liable to be segregated, and easily forms a low-temperature microstructure and thus has a large influence on toughness degradation.

Therefore, it is preferable to control a content of P to be as low as possible. In the present disclosure, the content of P is controlled to be 0.02% or less because there is no great difficulty in securing properties even when P is contained at a maximum of 0.02%.

S: 0.015% or Less

Sulfur (S) is an element which is inevitably contained (included) during manufacturing of steel. When a content of S is excessive, there is a problem that non-metallic inclusions are increased such that toughness is deteriorated.

Therefore, it is preferable to control the content of S to be as low as possible. In the present disclosure, the content of S is controlled to be 0.015% or less because there is no great difficulty in securing properties even when S is contained at a maximum of 0.015% at a maximum of 0.015%.

Nb: 0.005% to 0.05%

Niobium (Nb) is an element favorable for maintaining a fine microstructure during rolling through high-temperature precipitation, and is an element favorable for securing strength and impact toughness. In particular, in the present disclosure, the addition of Nb is required to stably obtain fine structure in addition to microstructure refinement secured by controlling a series of manufacturing conditions.

The content of Nb is determined by an amount of Nb dissolved by a temperature and time at reheating a slab for rolling, but the content exceeding 0.05% is not preferable because it generally exceeds a solution range. Meanwhile, when the content of Nb is less than 0.005%, the precipitation amount is insufficient and the above-mentioned effect may not be sufficiently obtained, which is not preferable.

Therefore, in the present disclosure, it is preferable that the content of Nb may be controlled to be 0.005 to 0.05%.

V: 0.005~0.08%

Vanadium (V) is an element favorable for securing strength of steel. In particular, in the present disclosure, since the content of C is limited to secure impact toughness of steel and the content of Mn is limited to control a segregation effect, it is possible to secure insufficient strength may be secured through the addition of the V without accelerated cooling, in addition to the limitations C and Mn. In addition, since V is precipitates at a low temperature region, there is an effect reducing the rolling load during rolling in a limited temperature range.

However, when the content of V exceeds 0.08%, precipitates may be excessively formed and brittleness may be caused, which is not preferable. However, when the content of V is less than 0.005%, an amount of precipitation is insufficient and the above-mentioned effect may not be sufficiently obtained, and thus it is not preferable.

Therefore, in the present disclosure, it is preferable to control the content of V to 0.005 to 0.08%.

Meanwhile, in the present disclosure, at least one or more of Ni and Cr may be further contained in an amount of 0.5% or less, respectively for further improving properties of the steel plate satisfying the alloy composition described above, and further Ti may be further contained in an amount of 0.05% or less.

Nickel (Ni) and Chromium (Cr) may be added to secure strength of steel, and it is preferable to add in an amount of 0.5% or less in consideration of carbon equivalent and the limitation of the elements essentially contained.

Titanium (Ti) may be added for surface quality control while adjusting the strength of the steel, but it is preferably added in an amount of 0.05% or less in consideration of an influence of grain boundary brittleness due to precipitates when excessively added.

A remainder of the above-mentioned composition is iron (Fe). However, since impurities which are not intended from raw materials or surrounding environments is able to inevitably incorporated, in a manufacturing process in the related art, they may not be excluded. These impurities are not specifically mentioned in the present specification, as they are known to anyone in the skilled art.

It is preferable that the steel plate of the present disclosure satisfying the alloy composition described above is a microstructure, which includes ferrite and pearlite mixed structures.

More specifically, in the present disclosure, by including 85 to 95% of ferrite and 5 to 15% of pearlite by an area fraction, a desired strength and impact toughness may be secured.

When the fraction of pearlite is excessive, the yield strength may be excessively increased as compared with the tensile strength.

As described above, in the thick steel plate including ferrite and pearlite mixed structures in the present disclosure, it is preferable that the grain size of ferrite is ASTM grain size number of 9 or more. When the grain size of ferrite is less than the ASTM grain size number of 9, coarse grains are formed and the strength and toughness at a target level may not be secured.

The grain size of ferrite is influenced by a grain size of austenite. Thus, in the present disclosure, it is preferable that the grain size of austenite is ASTM grain size number of 10 or more. When the grain size of austenite is less than the ASTM grain size number of 10, fine microstructure may not be obtained in a final product, and the desired properties may not be secured.

The thick steel plate of the present disclosure satisfying both the alloy composition and the microstructure as described above, has a yield ratio (yield strength (MPa)/tensile strength (MPa)) of 80 to 92%, has excellent cryogenic impact toughness of 300 J or more even at −70° C., and also has high strength.

It is preferable that the thick steel plate of the present disclosure has a thickness of 15 mmt and over, and more preferably, a thickness of 15 to 75 mmt.

Hereinafter, a manufacturing method for a thick steel plate having excellent cryogenic toughness, another aspect of the present disclosure, will be described in detail.

In brief, according to the present disclosure, the desired thick steel plate may be manufactured through [steel slab reheating-hot rolling-cooling] processes, and conditions for each step will be described in detail as below.

[Reheating Step]

First, it is preferable to prepare a steel slab satisfying the alloy composition described above, and then reheat the steel slab at a temperature of 1100° C. or higher.

The reheating process is to utilize a niobium compound formed during casting to perform microstructure refinement, and thus it is preferable that the reheating process is performed at a temperature of 1100° C. or higher in order to disperse and finely precipitate Nb after re-dissolution.

When the temperature of reheating is less than 1100° C., dissolution does not occur properly and fine grains may not be induced, and it is difficult to secure the strength in a final steel material. In addition, it is difficult to control the grains due to the precipitates, such that only microstructure refinement obtained by controlling of rolling conditions to be described later may not obtain stable microstructure refinement and desired physical properties.

[Hot Rolling]

It is preferable that the reheated steel slab is hot-rolled according to the above-described method to manufacture a hot-rolled steel plate.

In this case, finish rolling is preferably performed at a temperature within a range of 780 to 850° C.

When a temperature of performing the finish rolling is less than 780° C., rolling at two phase regions is performed, and there is a problem that formation of pro-eutectoid structures and deformation during rolling cause unevenness of residual stress after rolling and cutting resulting in difficulty in controlling a shape. On the other hand, when the temperature exceeds 850° C., recrystallization of austenite may lower the strength due to grain strength, which is not desirable.

When the shape is uneven after rolling, flatness should be secured by using a leveling facility, and there may be an additional residual stress on a plate due to the stress duringcold leveling. Therefore, it is important to perform hot leveling in the view of removing residual stress, and in the present disclosure, by performing hot finish rolling at a temperature within a range of 780 to 850° C., a single-phase region, a temperature required for hot leveling may be secured, and a recovery temperature at which the stress may be removed even after the leveling may be secured, and in a further processing of a final product, it is possible to significantly reduce the possibility of unevenness in shape, or the like.

[Cooling]

It is preferable that the hot-rolled steel plate manufactured according to the above-mentioned method is cooled to room temperature to prepare a final thick steel plate. In this case, it is preferable to perform air cooling at the time of cooling.

In the present disclosure, it is economically advantageous because it does not require a separate cooling facility by performing air cooling during cooling the hot-rolled steel plate, and even when air cooling is performed, all desired properties may be obtained.

Hereinafter, the present disclosure will be described more specifically through embodiments. It should be noted, however, that the following embodiments are intended to illustrate the present disclosure in more detail and not to limit the scope of the present disclosure. The scope of the present disclosure is determined by the matters set forth in the claims and the matters reasonably inferred therefrom.

MODE FOR INVENTION

Embodiment

A slab having an alloy composition illustrated in the following Table 1 was reheated at a temperature of 1100° C. or higher, and then performed finish hot rolling and cooling under the conditions illustrated in the following Table 2 to prepare a final thick steel plate.

In this case, a thick steel plate having a thickness of 25 mmt and a thickness of 50 mmt was prepared for Inventive Steel 1, respectively, and a thick steel plate having a thickness of 30 mmt was respectively for Inventive Steel 2 and 3, respectively. A thick steel plate having a thickness of 30 mmt for Comparative Steel 1, and a thick steel plate having a thickness of 25 mmt and a thickness of 30 mmt for Comparative Steel 2 and 3, respectively was prepared.

Thereafter, with respect to each thick steel plate, microstructure were observed using a microscope at a point of ¼t (where, t is thickness (mm)), and tensile characteristics were evaluated by using proportional specimen of $L_0=5.65\sqrt{S_0}$ (where, $L_0$ is an original gauge length, and $S_0$ is an original cross-sectional area) for the total thickness. The results are illustrated in Table 3 below.

In addition, Charpy V-Notch impact characteristics were evaluated for each thick steel plate, and the results thereof are illustrated in Table 4 below.

TABLE 1

| Classification | Alloy composition (weight %) | | | | | | | | | |
|---|---|---|---|---|---|---|---|---|---|---|
| | C | Mn | Si | P | S | Nb | Ti | V | Ni | Cr |
| Inventive Steel 1 | 0.08 | 1.55 | 0.40 | 0.010 | 0.002 | 0.024 | 0.011 | 0.046 | 0.001 | 0.001 |
| Inventive Steel 2 | 0.08 | 1.64 | 0.43 | 0.009 | 0.001 | 0.043 | 0.025 | 0.06 | 0.15 | 0.12 |
| Inventive Steel 3 | 0.08 | 1.63 | 0.42 | 0.009 | 0.001 | 0.050 | 0.025 | 0.06 | 0.15 | 0.15 |
| Comparative Steel 1 | 0.08 | 1.54 | 0.30 | 0.009 | 0.002 | 0.021 | 0.014 | 0.002 | 0.006 | 0.019 |
| Comparative Steel 2 | 0.08 | 1.50 | 0.42 | 0.011 | 0.002 | 0.025 | 0.012 | 0.092 | 0.001 | 0.002 |
| Comparative Steel 3 | 0.08 | 1.65 | 0.44 | 0.011 | 0.002 | 0.054 | 0.025 | 0.06 | 0.16 | 0.15 |

TABLE 2

| Classification | Manufacturing condition | | |
|---|---|---|---|
| | Finish hot rolling | Cooling | Thickness (mmt) |
| Inventive Steel 1 | 820° C. | Air cooling | 50 or 25 |
| Inventive Steel 2 | 820° C. | Air cooling | 30 |
| Inventive Steel 3 | 820° C. | Air cooling | 30 |
| Comparative Steel 1 | 820° C. | Water cooling (25° C./s) | 30 |
| Comparative Steel 2 | 820° C. | Air cooling | 25 |
| Comparative Steel 3 | 820° C. | Air cooling | 30 |

TABLE 3

| Classification | Microstructure | | | | Mechanical properties | | |
|---|---|---|---|---|---|---|---|
| | Phase | F fraction | AGS | FGS | TS (MPa) | YS (MPa) | YR (%) |
| Inventive Steel 1 (50 mmt) | F + P | 89% | 10.2 | 9 | 498 | 414 | 83 |
| Inventive Steel 1 (25 mmt) | F + P | 88% | 10.3 | 9.5 | 512 | 427 | 83 |
| Inventive Steel 2 | F + P | 87% | 10.2 | 9.5 | 548 | 466 | 85 |
| Inventive Steel 3 | F + P | 86% | 11.0 | 9.7 | 573 | 490 | 86 |
| Comparative Steel 1 | F + P | 89% | 10.5 | 9.5 | 553 | 463 | 84 |
| Comparative Steel 2 | F + P | 89% | 10.7 | 9.5 | 615 | 520 | 85 |
| Comparative Steel 3 | F + P | 86% | 11.0 | 9.5 | 575 | 491 | 85 |

(In Table 3, a remainder excluding a F fraction is P, where F is ferrite and P is pearlite.)

TABLE 4

| Classification | Impact characteristics (J) | | | | | |
|---|---|---|---|---|---|---|
| | 0° C. | −20° C. | −40° C. | −50° C. | −60° C. | −70° C. |
| Inventive Steel 1 (50 mmt) | 401 | 411 | 392 | 400 | 385 | 341 |
| Inventive Steel 1 (25 mmt) | 411 | 421 | 413 | 403 | 415 | 413 |
| Inventive Steel 2 | 400 | 391 | 380 | 385 | 390 | 360 |

TABLE 4-continued

| Classification | Impact characteristics (J) | | | | | |
|---|---|---|---|---|---|---|
| | 0° C. | −20° C. | −40° C. | −50° C. | −60° C. | −70° C. |
| Inventive Steel 3 | 390 | 387 | 377 | 378 | 386 | 370 |
| Comparative Steel 1 | 330 | 332 | 314 | 264 | 260 | 200 |
| Comparative Steel 2 | 310 | 120 | 27 | 15 | 17 | 12 |
| Comparative Steel 3 | 388 | 384 | 378 | 386 | 367 | 362 |

As illustrated in the Table 3, it can be confirmed that the thick steel plate of the present disclosure may secure the same properties as those of steel (Comparative Steel 1), which secures properties through water cooling after conventional rolling (grain size, yield ratio, and the like) even though an air cooling process was performed during cooling after rolling.

Meanwhile, Comparative Steel 3 illustrates that an increase in strength is insufficient, even though an addition amount of Nb is excessive. This is due to the fact that an effect of Nb is not sufficiently occurred due to the limitation of the amount of solid solution even when the addition amount of Nb is increased.

In addition, as illustrated in Table 4, it can be confirmed that impact transition does not occur up to −70° C. in the thick steel plate of the present disclosure.

Meanwhile, in the case of comparative steel 2, a content of V in the steel alloy composition is excessive, and it can be confirmed that impact transition occurred near −40° C. region.

In manufacturing the thick steel plate, an influence of an extraction temperature on the strength at the time of reheating slab was confirmed. Specifically, the slab of Inventive Steel 1 was heated to satisfy the respective extraction temperatures illustrated in Table 5, and then performed finish hot rolling at a temperature of 820° C. to have a thickness of 25 mmt, and then performed air cooling to room temperature to prepare respective thick steel plates.

Thereafter, the tensile characteristics of each of the above-mentioned thick steel plates were evaluated.

TABLE 5

| Tensile strengths | 1168° C. | 1165° C. | 1162° C. | 1150° C. | 1124° C. | 1100° C. | 1090° C. |
|---|---|---|---|---|---|---|---|
| Yield strength(MPa) | 448 | 442 | 438 | 427 | 388 | 375 | 360 |
| Tensile strength(MPa) | 525 | 522 | 519 | 512 | 474 | 470 | 465 |
| Yield ratio(%) | 85 | 85 | 84 | 83 | 82 | 80 | 77 |

As illustrated in the Table 5, it can be confirmed that the strength is lowered as the extraction temperature is lowered. In particular, when the extraction temperature is 1090° C., it can be confirmed that the strength is lowered to be about 60 to 90 MPa compared with the case in which the extraction temperature is 1168° C. and the yield ratio is also lowered to be less than 80%.

As the extraction temperature is lowered, an Nb reuse effect, affecting the microstructure refinement, and the like, is reduced, which causes a decrease in strength and yield ratio under similar rolling conditions.

Therefore, it can be confirmed that it is preferable to perform that the extraction temperature is 1100° C. or higher, during reheating.

The invention claimed is:

1. A steel plate, by weight %, comprising: 0.02 to 0.10% of carbon (C), 0.6 to 1.7% of manganese (Mn), 0.5% or less of silicon (Si) (excluding 0%), 0.02% or less of phosphorus (P), 0.015% or less of sulfur(S), 0.005 to 0.05% of niobium (Nb), 0.005 to 0.08% of vanadium (V), a balance of iron (Fe) and inevitable impurities, and having a microstructure consisting of 85 to 95% of ferrite and 5 to 15% of pearlite by an area fraction, wherein a grain size of austenite is ASTM grain size number of 10 or more and a grain size of ferrite is ASTM grain size number of 9 or more, the thickness of the steel plate is 15 to 75 mm, the steel plate has a yield ratio (yield strength (MPa)/tensile strength (MPa)) of 80 to 92%, and impact toughness at −70° C. of 300J or more, and the steel plate has the tensile strength of 470 to 525 MPa.

2. The steel plate of claim 1, wherein the steel plate further comprises, by weight %, one or more of 0.5% or less of Ni and 0.5% or less of Cr.

3. The steel plate of claim 1, wherein the steel plate further comprises, by weight %, 0.05% or less of Ti.

4. The steel plate of claim 1, wherein the steel plate further comprises, by weight %, 0.001% or more and 0.5% or less of Ni.

5. The steel plate of claim 1, wherein the steel plate further comprises, by weight %, 0.15% or more and 0.5% or less of Ni.

6. The steel plate of claim 1, wherein the steel plate further comprises, by weight %, 0.40% or more and 0.5% or less of silicon (Si).

7. The steel plate of claim 1, wherein the steel plate further comprises, by weight %, 0.046 to 0.08% of vanadium (V).

* * * * *